US010238205B2

(12) United States Patent
Dickey et al.

(10) Patent No.: US 10,238,205 B2
(45) Date of Patent: Mar. 26, 2019

(54) TABLE AND SEATING ARRANGEMENT

(71) Applicant: Sico Incorporated, Edina, MN (US)

(72) Inventors: Christopher C Dickey, West St. Paul, MN (US); Monica Svobodny, Eden Prairie, MN (US)

(73) Assignee: Sico Incorporated, Edina, MN (US)

( * ) Notice: Subject to any disclaimer, the term of this patent is extended or adjusted under 35 U.S.C. 154(b) by 82 days.

(21) Appl. No.: 15/443,937

(22) Filed: Feb. 27, 2017

(65) Prior Publication Data

US 2017/0245632 A1 Aug. 31, 2017

Related U.S. Application Data

(60) Provisional application No. 62/301,366, filed on Feb. 29, 2016.

(51) Int. Cl.

| | |
|---|---|
| ***A47B 3/14*** | (2006.01) |
| ***A47B 3/087*** | (2006.01) |
| ***A47B 3/083*** | (2006.01) |

(52) U.S. Cl.

CPC ..... *A47B 3/14* (2013.01); *A47B 3/083* (2013.01); *A47B 3/087* (2013.01); *A47B 2003/145* (2013.01)

(58) Field of Classification Search

CPC ..... A47B 3/14; A47B 3/083; A47B 3/087; A47B 2003/145

USPC ..... 108/169, 168, 167, 166, 171, 173, 174; 297/158.4, 159.1; 24/313, 573.11

See application file for complete search history.

(56) References Cited

U.S. PATENT DOCUMENTS

| | | | | |
|---|---|---|---|---|
| 2,936,820 A | | 5/1960 | Blink et al. | |
| 3,101,062 A | * | 8/1963 | Kanzelberger | A47B 3/14 108/173 |
| 3,109,678 A | * | 11/1963 | Wilson | A47B 3/14 108/155 |
| 3,216,378 A | * | 11/1965 | Hoppe | A47B 9/18 108/116 |
| 3,797,884 A | * | 3/1974 | Gutierrez | A47B 3/14 297/158.4 |

(Continued)

FOREIGN PATENT DOCUMENTS

| | | |
|---|---|---|
| CA | 2455879 | 5/2001 |
| JP | S49 7283 | 2/1974 |

OTHER PUBLICATIONS

International Search Report dated May 8, 2017 from corresponding PCT.

*Primary Examiner* — Jose V Chen

(74) *Attorney, Agent, or Firm* — Merchant & Gould P.C.

(57) ABSTRACT

A folding table and seating arrangement includes a pair of table tops, each of the table tops having a table top frame. A folding framework supports the table tops and facilitates folding the table tops between a first position and a second position, the folding framework defining a rotational axis with each of the table tops. A folding assist system offset forces during folding and includes a mechanical strut assembly attached to the folding framework and providing a biasing force. Cap elements have a receiving portion inserting into an orifice in the table top frame and aligned with the rotational axis to receive a tubular cross. The cap elements provide low friction and have tabs that clip into corresponding slots in the table top frame.

17 Claims, 11 Drawing Sheets

(56) References Cited

U.S. PATENT DOCUMENTS 3,963,101 A * 6/1976 Stadelmann ..... A47C 3/30 188/300
4,026,221 A * 5/1977 Wilson ..... A47B 3/087 108/169
4,120,249 A * 10/1978 Blink ..... A47B 3/087 108/130
4,133,271 A * 1/1979 Carlson ..... A47B 3/087 108/174
4,596,196 A * 6/1986 Gunter ..... A47B 3/083 108/169
4,949,649 A * 8/1990 Terres ..... E04H 3/28 108/116
5,020,799 A * 6/1991 Chang ..... A47B 3/087 108/115
5,170,539 A * 12/1992 Lundstedt ..... A44B 11/006 24/194
6,186,591 B1 * 2/2001 Pajerski ..... A47B 3/14 108/125
6,223,661 B1 * 5/2001 Griepentrog ..... A47B 3/14 108/115
6,378,446 B1 * 4/2002 Long ..... A47B 9/02 108/147
8,065,966 B1 * 11/2011 Bacon ..... A47B 9/16 108/145
8,181,583 B2 * 5/2012 Rivera, Jr. ..... A47B 3/14 108/168
8,205,937 B2 * 6/2012 Rivera, Jr. ..... A47B 3/14 108/169
8,573,139 B2 * 11/2013 Ashby ..... A47B 3/087 108/126
2012/0054992 A1 * 3/2012 Liu ..... F16B 12/24 24/573.11
2013/0300044 A1 11/2013 Adoline

* cited by examiner

TABLE AND SEATING ARRANGEMENT

BACKGROUND OF THE INVENTION

Field of the Invention

The present invention is directed to a folding table and seating arrangement and more particularly to a folding table and seating structure having a lightweight frame and a folding-assist system.

Description of the Prior Art

In large multi-purpose rooms utilized at various times as dining rooms, meeting halls, dance areas, training rooms, classrooms and for other varied activities, it is often desirable that furniture having a flexible configuration be used. In particular, folding table and seating structures have proven to be useful and are utilized in schools for common areas, lunchrooms and for other applications. Such folding table and seating systems provide a smaller footprint when folded for storage and increase the flexibility for multiple uses of spaces. Examples of folding tables are shown for example in U.S. Pat. No. 2,771,937 to Wilson, U.S. Pat. No. 3,075,809 to Wilson, U.S. Pat. No. 3,099,480 to Wilson and U.S. Pat. No. 6,254,178 to Bue, all assigned to Sico, Inc., the Assignee of the present invention. Although such tables provide great flexibility, further improvements are possible.

Folding table and seating systems require a framework for supporting opposed table tops as well as benches or stools and are typically on casters. The weight of the folding table and seating systems produces forces that may vary during the folding and unfolding of such systems and may increase the effort required by workers during folding and unfolding. Therefore, such systems often utilize a folding-assist system to aid in the folding and unfolding process so that less effort is required from workers performing the folding and unfolding. Such folding-assist has generally been provided by torsion bars and/or pneumatic cylinders. The torsion bars have generally been inserted along a pivot axis of the legs and connect to the table frame. Although torsion bars may counteract some of the weight and gravity to lessen the effort required, torsion bars are expensive, relatively heavy and add weight. Torsion bars may require special mounting to the frame to ensure torque is applied. Moreover, a torsion bar usually includes a preset amount of torsion that is not adjusted, although the amount of torque may change throughout the range of folding motion of the table. Folding table and seating systems also utilize pneumatic cylinders, often referred to as gas springs, which provide a degree of folding-assist. However, gas springs have a limited force ratio, which is the force at full extension compared to the force at full compression. A typical force ratio for gas cylinders is about 1.5, which limits the ability to vary the force exerted during folding and unfolding to provide folding assist to cancel out forces of the table and provide controlled folding and unfolding. Moreover, such gas cylinders tend to suffer from leakage and lose some of the force exerted as they age. Therefore, it is common practice for such cylinders to be initially configured to provide greater force than is actually required in order to make up for the expected loss of force exerted due to gas leakage over time.

It can therefore be seen that a new and improved folding table and seating system is needed with an improved folding-assist system. Such a system should provide folding assist that does not diminish over the life of the folding table and seating system. Moreover, such a system should be lightweight and provide easy rotation between frame elements during folding and unfolding. A folding assist system should be tuned to provide folding-assist that increases and/or decreases during portions of the range of folding and unfolding motion where different folding assist force is needed. The framework should be easy to assemble and should eliminate torsion bars at rotational axes of the folding framework. The present invention addresses these as well as other problems associated with folding table and seating systems and their folding linkages.

SUMMARY OF THE INVENTION

The present invention is directed to a table and seating arrangement and in particular to a table and seating arrangement having a folding framework using mechanical struts for folding assist and cap elements providing low friction rotational support at frame rotational axes.

The folding table and seating arrangement includes a pair of table tops folding relative to each other about a center folding plane and may include associated seating. Each of the table tops has an associated table top frame. A folding framework supports the table tops and provides for folding the table tops between a first position for use and a second position for storage. The folding framework defines at least one rotational axis with each of the table tops. A folding assist system offsets forces from the weight of the arrangement during folding and unfolding and reduces the effort required to fold and unfold the table and seating arrangement. The folding assist system includes a mechanical strut assembly attached to the folding framework and providing a biasing force. Moreover, rather than torsion springs at rotational axes of the frame, a pair of caps, each having a low friction receiving portion, insert into an orifice in the table top frame and are aligned with the rotational axis. The caps receive ends of tubular frame members that pivot about the rotational axis. The caps provide easy assembly as each cap includes a receiving portion that inserts into a hole in the table top frame and retaining tabs that clip into slots in the table top frame.

The folding assist system is tuned to offset forces resisting and/or accelerating folding and unfolding of the folding table and reduce the work required by workers. The folding assist system includes a mechanical strut assembly with a telescoping portion. A first end of the strut assembly mounts to the folding framework and a second end of the mechanical strut assembly mounts to the table top frame. The spring rate of the mechanical strut may be designed to vary along the range of motion of the table and seating arrangement to substantially cancel the weight and other forces encountered while folding and unfolding. Mechanical struts have a comparatively high force ratio of about 4. This higher force ratio than gas springs allows a mechanical strut to be better tuned to optimize fold assist as forces may be varied more during folding and unfolding. The mechanical strut assembly may include a first spring and a second spring with the first spring having a different spring constant than the second spring.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

Referring to the drawings wherein like reference numerals and letters indicate corresponding structure throughout the several views.

DETAILED DESCRIPTION OF THE PREFERRED EMBODIMENT

Figure 1:
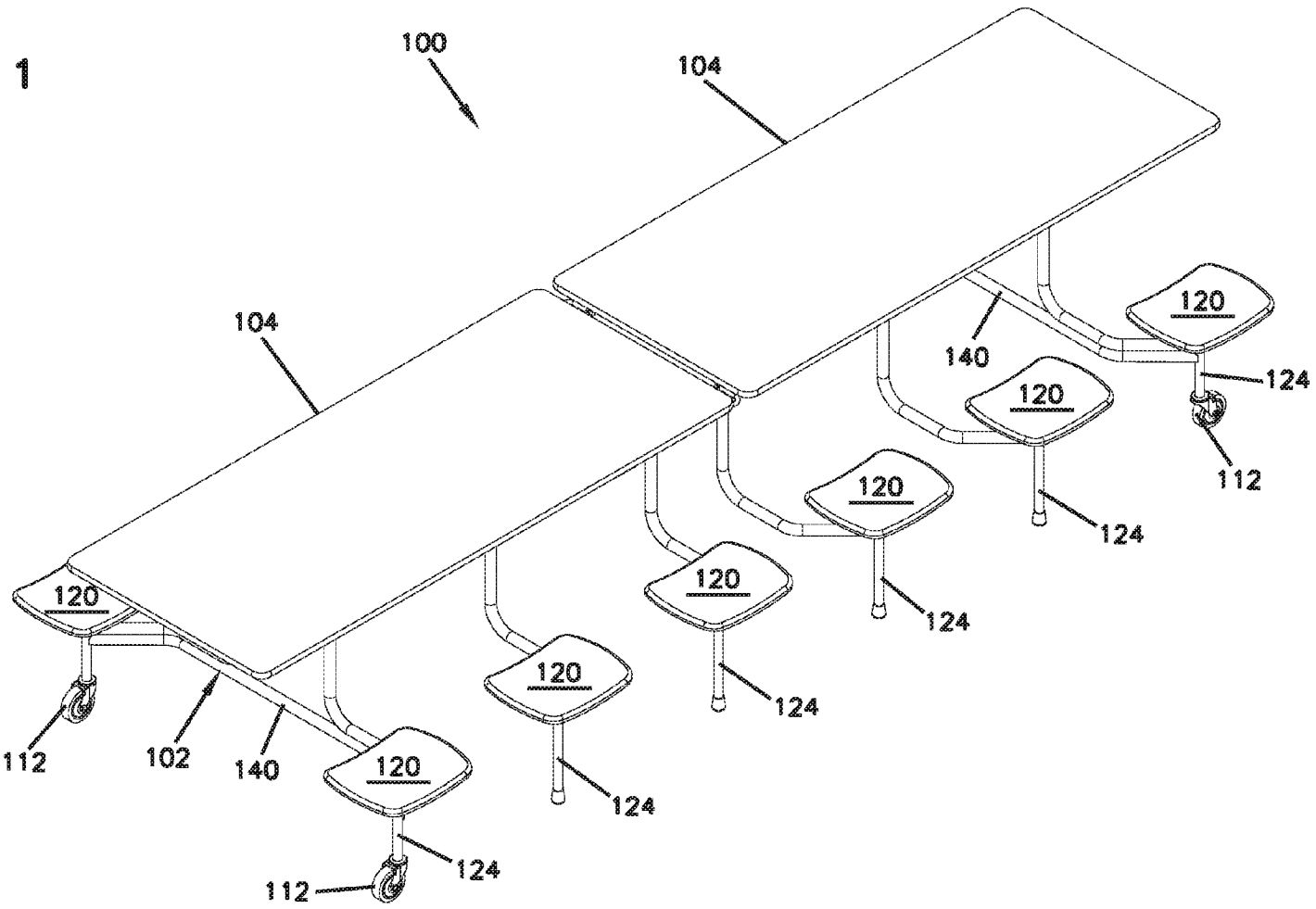
FIG. 1 is a perspective view of a folding table and seating assembly in an unfolded use position.
Figure 3:
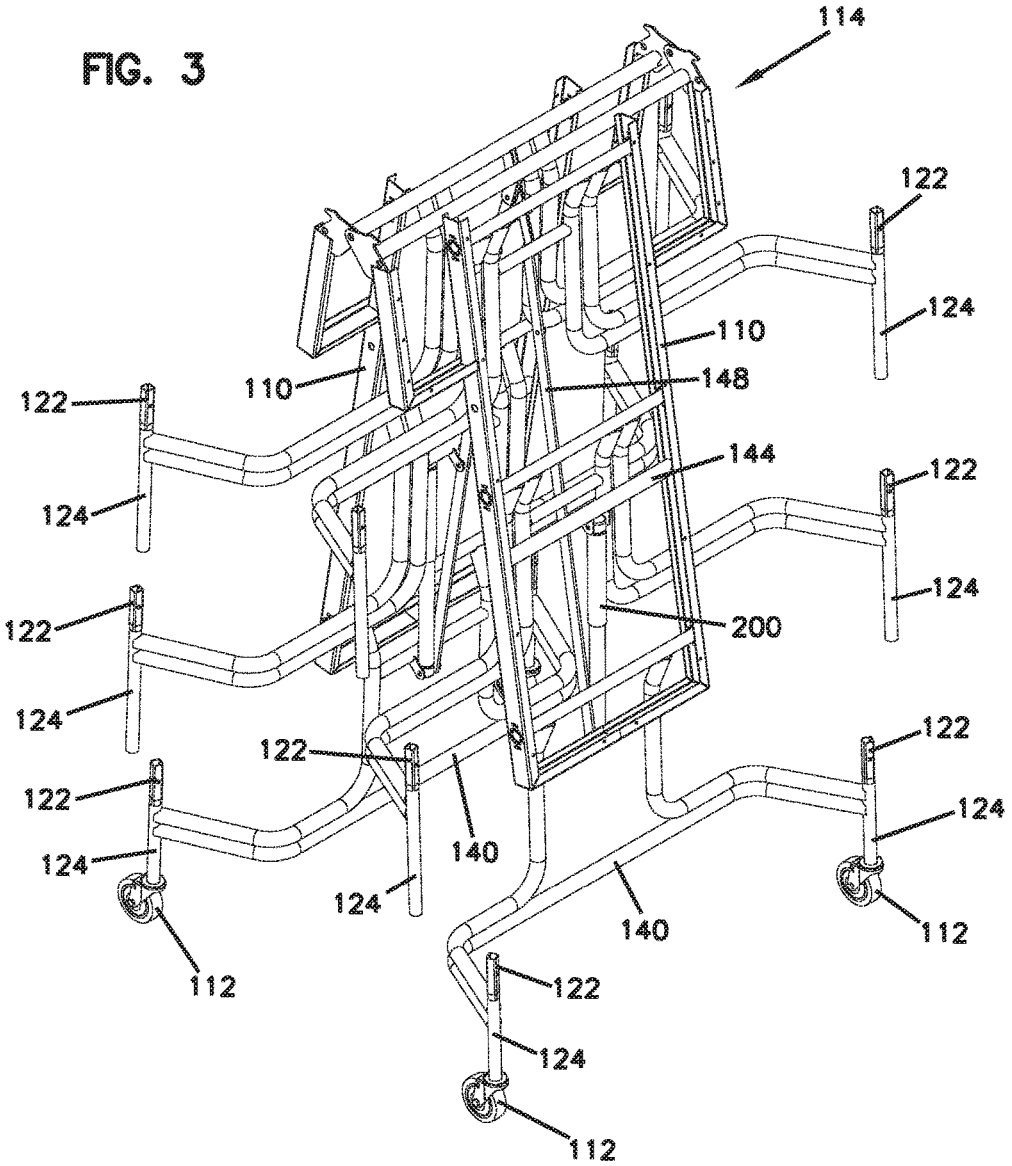
FIG. 3 is a perspective view of the table and seating assembly of FIG. 2 in a folded position.
Figure 4:
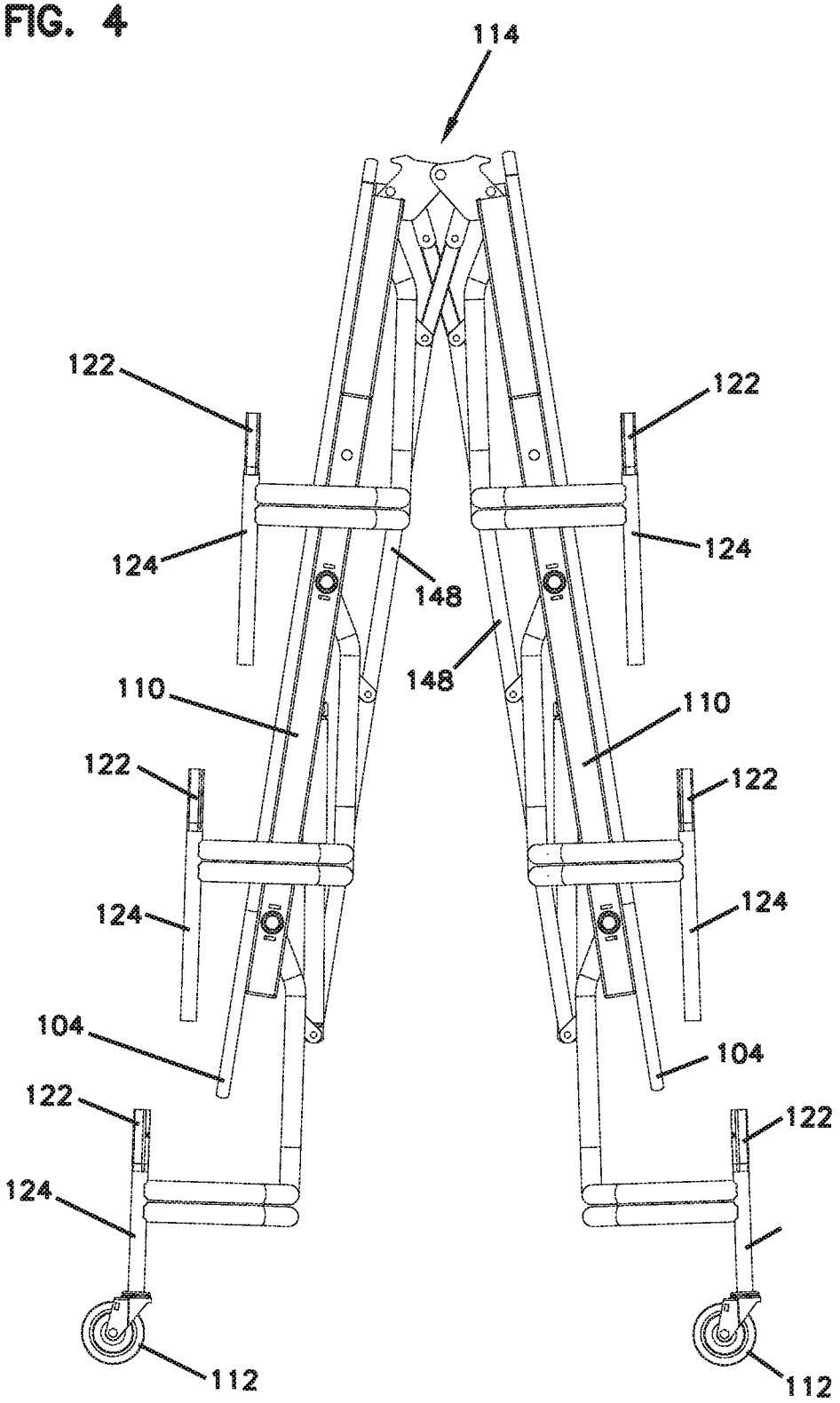
FIG. 4 is a side elevational view of the table and seating assembly of FIG. 1 in a folded position with seating removed for clarity.

Referring now to the drawings and in particular to FIG. 1, there is shown a table and seating arrangement, generally designated (100). The table and seating arrangement (100) includes table tops (104) supported by a folding framework (102). The framework (102) includes several interconnected frame elements as discussed hereinafter. The table and seating arrangement (100) mounts on four casters or wheels (112) so that when folded such as shown in FIGS. 3 and 4, the table and seating arrangement (100) may be rolled from location to location for use and storage. The framework (102) also supports seating (120). Although shown as stools (120), the seating (120) may be benches rather than stools or a combination of benches and stools. It can also be appreciated that multiple embodiments are possible with various types and/or numbers of seating assemblies (120). In addition, one or more of the seating assemblies (120) may be omitted, thereby providing ADA seating.

Figure 2:
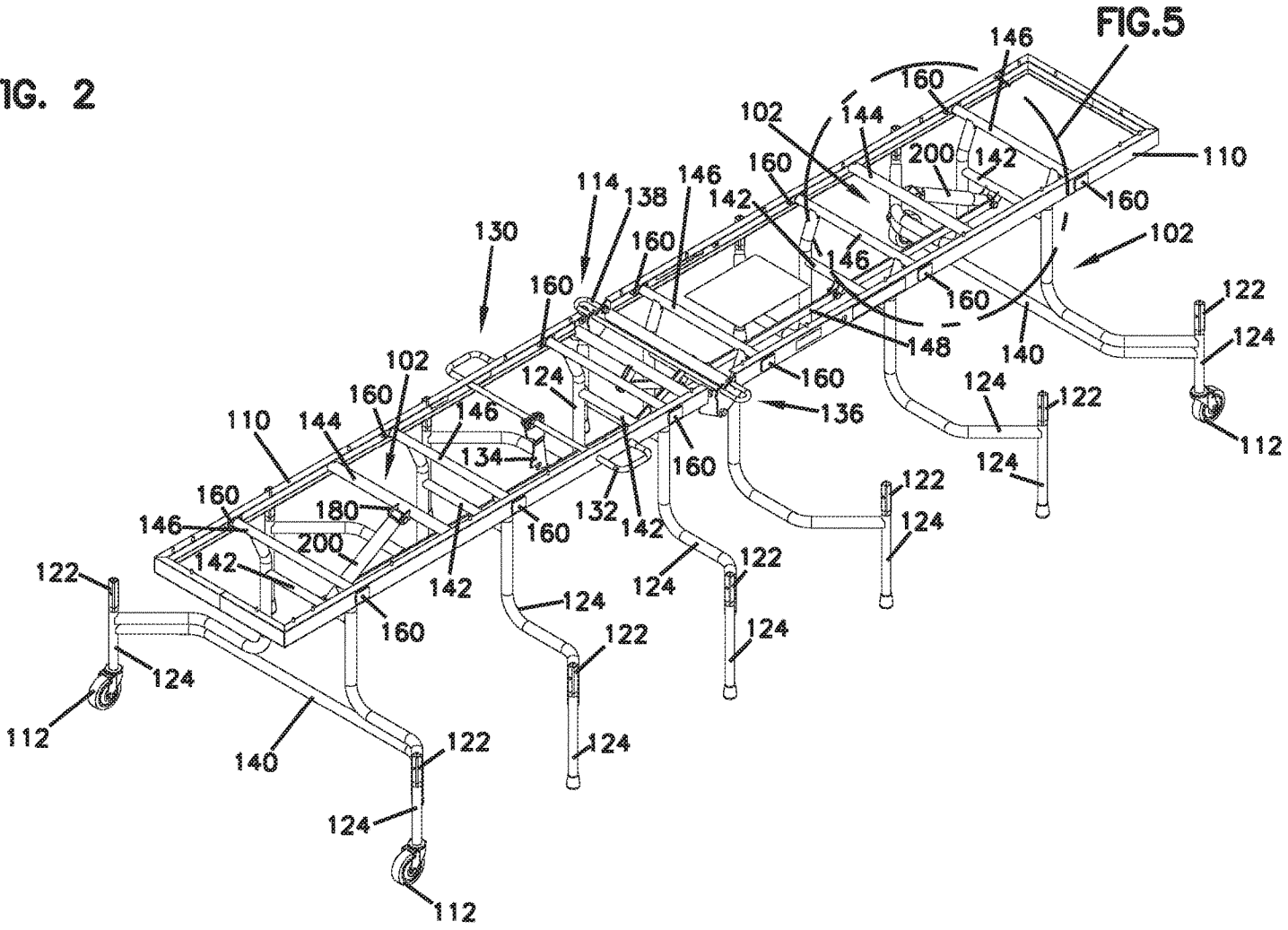
FIG. 2 is a perspective view of the table and seating assembly of FIG. 1 with the table tops and seating removed for clarity.

Referring now to FIGS. 2-4, the folding framework (102) supports a table top frame (110) associated with each of the table tops. The table top frame (110) mounts to an underside of an associated one of the table tops.

The table top frame (110) for each of the table tops (104) connect to one another via a center folding linkage (114). The center linkage (114) connects the table tops (104) and their associated frameworks (102) and includes links that provide for folding action between the adjacent center portions of the table tops (104) and includes linkage members extending between the frames (110) of the table tops (104). As shown in FIG. 2, the table and seating arrangement (100) may also include a first lock (130) including a first lock handle (132) and first lock engagement member (134) that are configured for engaging the cross member from the folding framework of the opposed table top when in a folded storage position. In addition, the table and seating arrangement (100) may include a second lock (136) including a second lock handle (138) actuating a safety that must be actuated to release the folding framework and allow folding from the use position shown in FIGS. 1 and 2.

Referring again to FIGS. 2-5, the folding framework (102) includes a framework assembly associated with each of the table tops (104). The folding framework (102) includes end lower cross members (140) at each opposed end of the table tops and connecting legs (124). The end legs are mounted on the casters (112) to provide for transporting the table and seating arrangement (100) when in the folded position as shown in FIGS. 3 and 4. The seating (120) is supported on seat supports (122) extending upward from the lower portion of the legs (124). The legs (124) form part of the folding framework (102) and include sections that extend inward and upward from below the seats to under the table top. The folding framework (102) also includes middle cross member (142) and upper cross member (144). A mechanical strut (200) connects to an upper cross member (144) of the table top frame (110). The middle cross member (142) connects the legs (124) of each opposed pair of legs. A linkage element (148) connects the middle cross members (142) of each pair of legs (124) and extends along a longitudinal direction of the table and seating arrangement (100). The linkage element (148) actuates the folding and unfolding of all pairs of opposed legs (124) together.

The upper end of each pair of legs (124) mounts to a tubular member (146). The tubular member (146) extends transverse to the longitudinal direction of the table and seating arrangement (100) and is rotatably mounted in cap elements (160) mounted in the table top frame (110) with the cap elements (160) receiving opposed ends of a tubular member (146).

Figure 5:
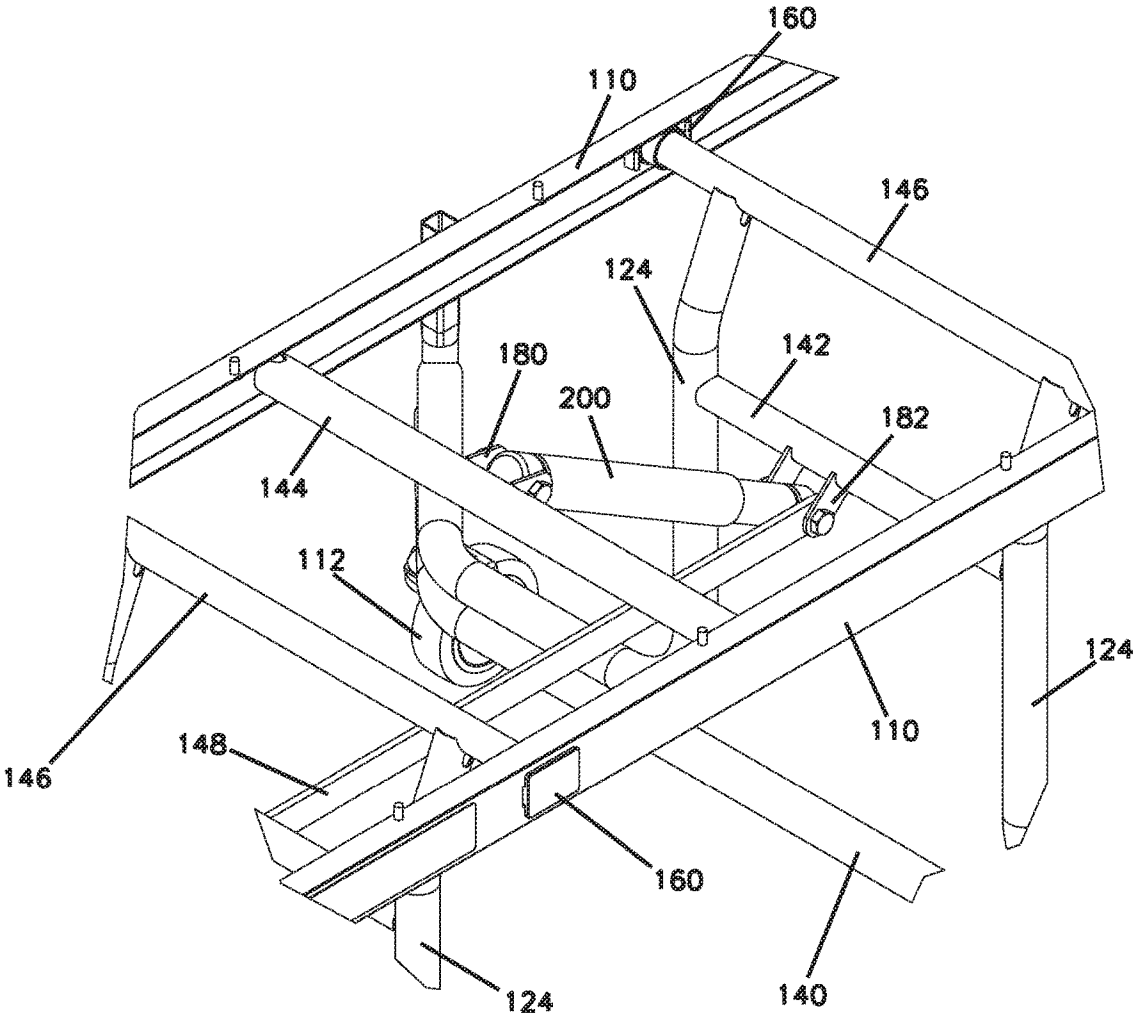
FIG. 5 is a perspective detail view of the folding frame and linkage for the table and seating assembly shown in FIG. 2.

The mechanical strut (200) attaches to the upper cross member (144) through upper spring mounts (180) and connects to the middle cross member (142) via lower spring mounts (182) as shown most clearly in FIG. 5. The spring mounts (180, 182) include a cross pin that allows relative rotation between the mechanical strut (200) and the spring mounts (180, 182). Therefore, the cross members (142, 144) may be fixedly mounted to the other frame elements of the table top frame (110) and do not require rotation relative to the other portions of the folding framework (102) and the table top frame (110). As explained hereinafter, the mechanical strut (200) is extensible to retract and extend during folding and unfolding between the position shown in FIGS. 1 and 2 and the position shown in FIGS. 3 and 4. Moreover, the mechanical strut (200) is tuned so that it provides forces in a preset manner to offset at least a portion of the loads encountered during folding and unfolding to decrease the effort required by workers to fold and unfold the table and seating arrangement (100).

Figure 6:
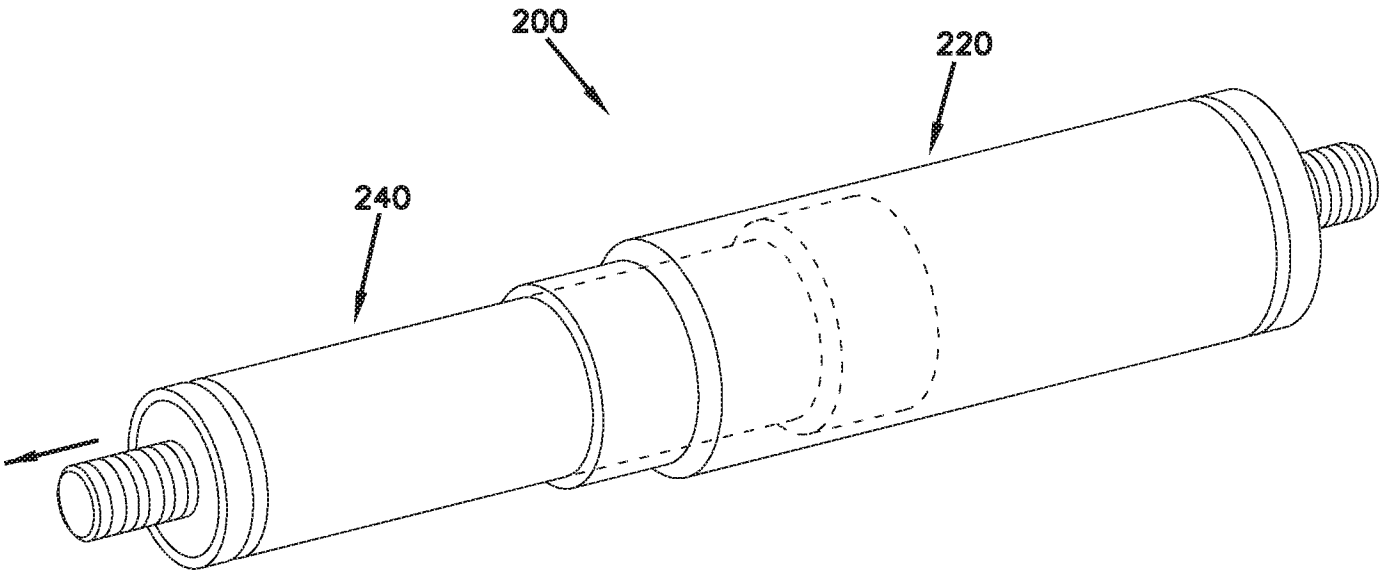
FIG. 6 is a perspective view of a telescoping mechanical strut for the linkage shown in FIG. 5.
Figure 7:
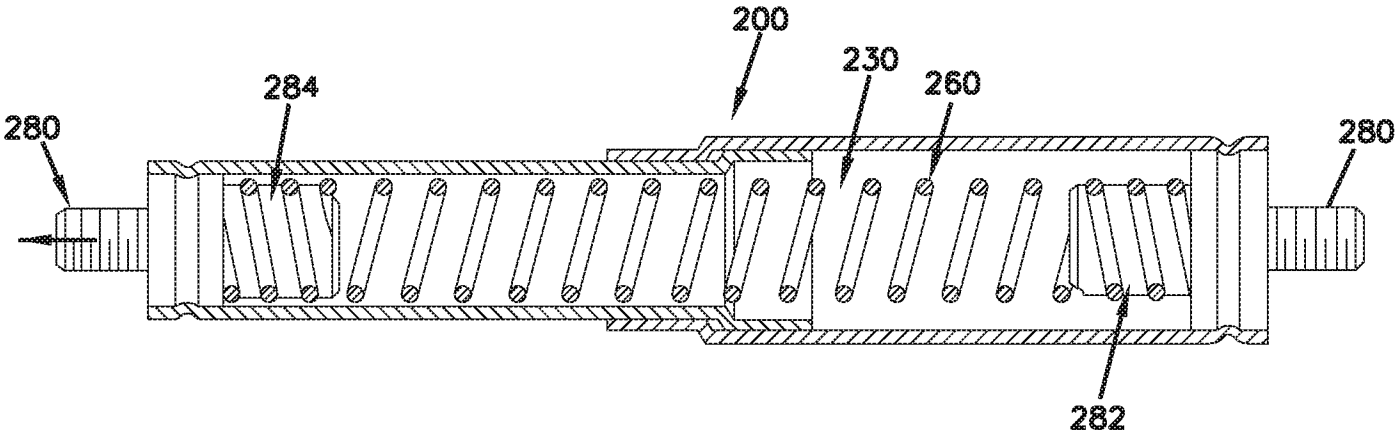
FIG. 7 is a sectional view of a first embodiment of the mechanical strut shown in FIG. 6.
Figure 8:
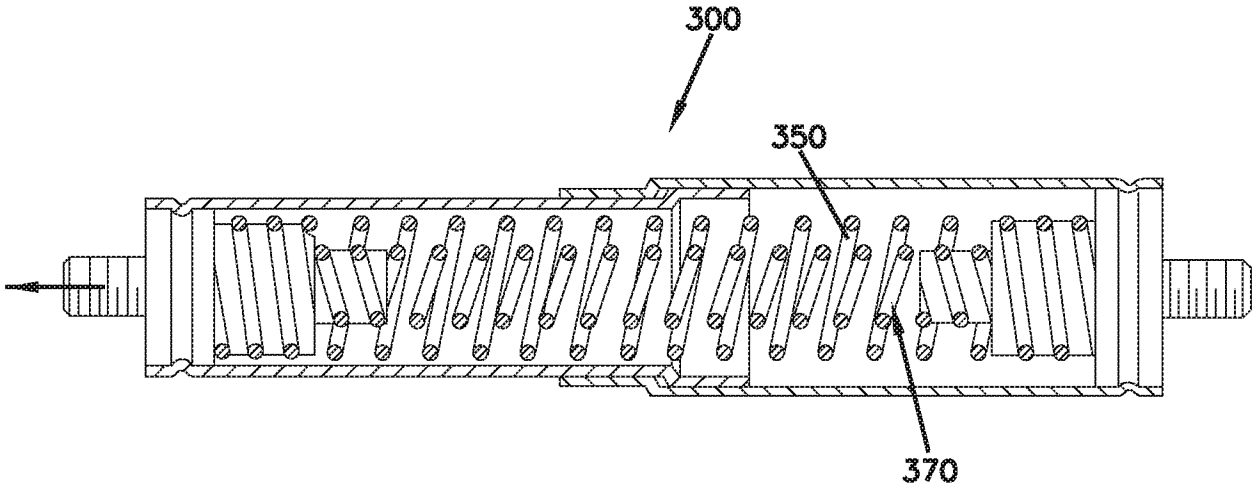
FIG. 8 is a sectional view of a second embodiment of the mechanical strut shown in FIG. 6.
Figure 9:
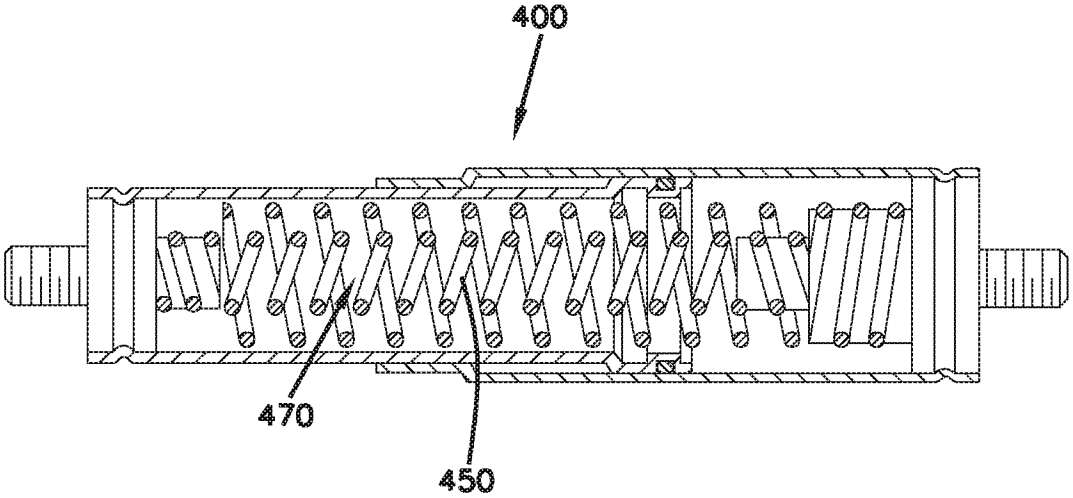
FIG. 9 is a sectional view of a third embodiment of the mechanical strut shown in FIG. 6.

Referring now to FIGS. 6-9, there is shown a mechanical strut (200, 300, 400) such as may be utilized for the table and seating apparatus (100). Such struts are described in greater detail in U.S. Pat. No. 9,188,184, incorporated herein by reference. Although a first embodiment of the mechanical strut (200) is shown in FIGS. 2, 3 and 5, it can be appreciated that the mechanical struts (300, 400) shown in FIGS. 8 and 9 are interchangeable and may also be used with table and seating arrangements, with the particular configuration depending on the needs and requirements of the application. As shown in FIG. 6, the first embodiment of the mechanical strut assembly (200) includes a first housing (220) and second housing (240). The first housing (220) includes an internal chamber (230) extending between front and rear ends. The second housing (240) also has an inner chamber (250) extending between the front and rear ends.

The second housing (240) is configured to partially nest and telescopically insert into the internal chamber of the first housing (220), as shown in FIG. 7. The front end (244) of the second housing is inserted into the inner chamber (230) of the first housing (220). The spring includes a mechanical spring element (260). A helical spring element (260) is shown, but it can be appreciated that the size, shape and material of the mechanical spring element (260) may be varied to meet the needs of the particular application.

The mechanical spring element includes a first end (262) and a second end (260) with a plurality of coils (266) between the first and second ends generally forming a helix with an inner open region along a longitudinal length of the mechanical spring element (262). The spring may engage a body (272) and may threadably connect to a complementary end region (282, 284). The mechanical strut assembly (200) attaches the housings (220, 240) externally via connectors (280) that may be threaded or use other conventional configurations as may be required depending upon the mounting requirements.

Moreover, as shown in FIGS. 8 and 9, other embodiments of the mechanical strut (300, 400) may include multiple spring elements. As shown in FIG. 8, multiple mechanical spring elements (260) may be implemented together. First and second spring elements (350, 370) may be utilized and may be helical spring elements. The materials and other configurations of the spring elements may be varied to modify the spring constant. Similarly, as shown in FIG. 9, two springs (450, 470) may be utilized together. As shown in the embodiment of FIG. 9, the windings of the springs (450, 470) may extend in opposite directions.

The mechanical struts (200, 300, 400) may be tuned to minimize the amount of work required for users that are folding and unfolding the table and seating arrangement. The springs may be manufactured to be in a neutral stable state or may include a preset compression or extension to bias to pull toward or to push away from the mechanical strut assembly (200). Moreover, the spring dimensions and materials may be varied along the length of the springs so that the spring (260) extends or retracts at different rates and/or with different force for different portions of the folding and unfolding motion. The extensions and compressions may be matched to varying forces from gravity along the path of motion as the table and seating arrangement (100) is folded and unfolded. By matching the forces exerted by the mechanical strut assembly (200), larger forces required to either fold or unfold the table and seating arrangement (100) may be substantially negated. Therefore, the effort required to fold and unfold the table and seating arrangement (100) may be substantially reduced and therefore save labor. Moreover, the folding and unfolding achieves improved control and therefore improved safety. Furthermore, using the multiple spring elements, the springs may be varied and combined to improve the matching of the forces exerted by the springs to the forces encountered during different phases of folding and unfolding.

Figure 10:
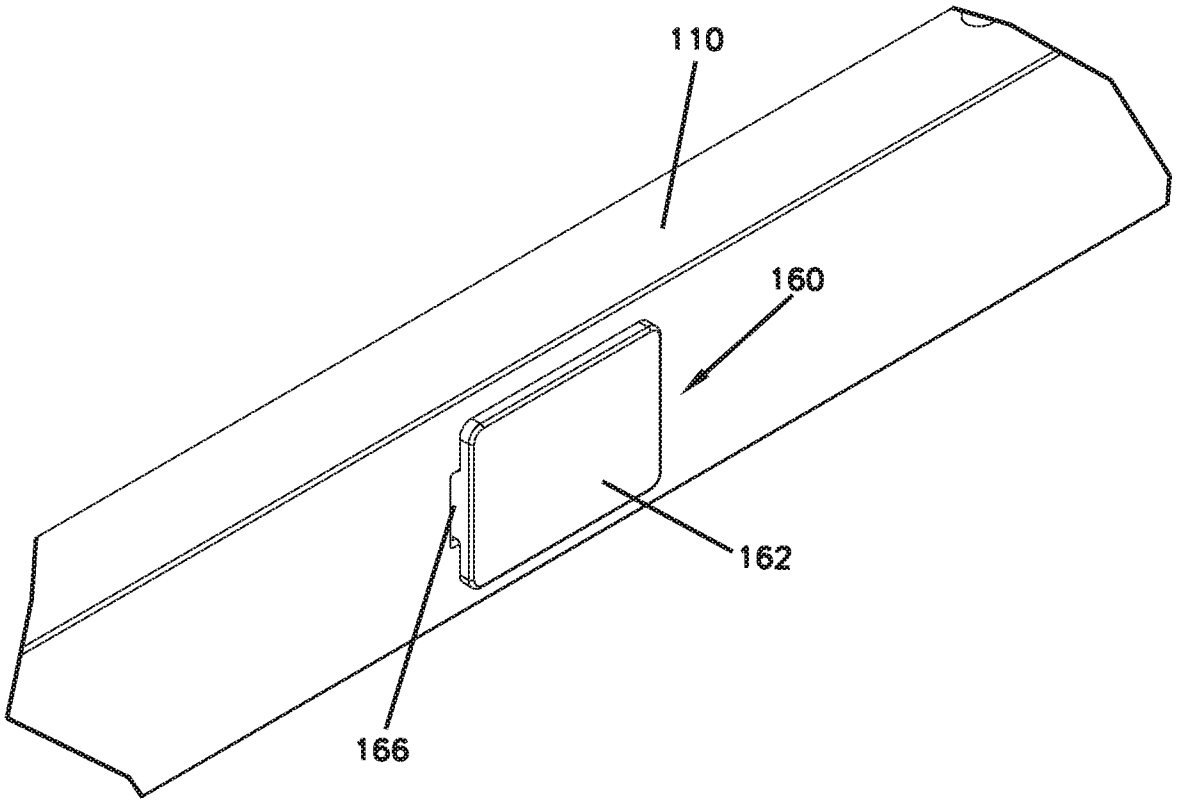
FIG. 10 is a perspective view of the clip mounted to the frame of the of the table and seating assembly of FIG. 1.
Figure 11:
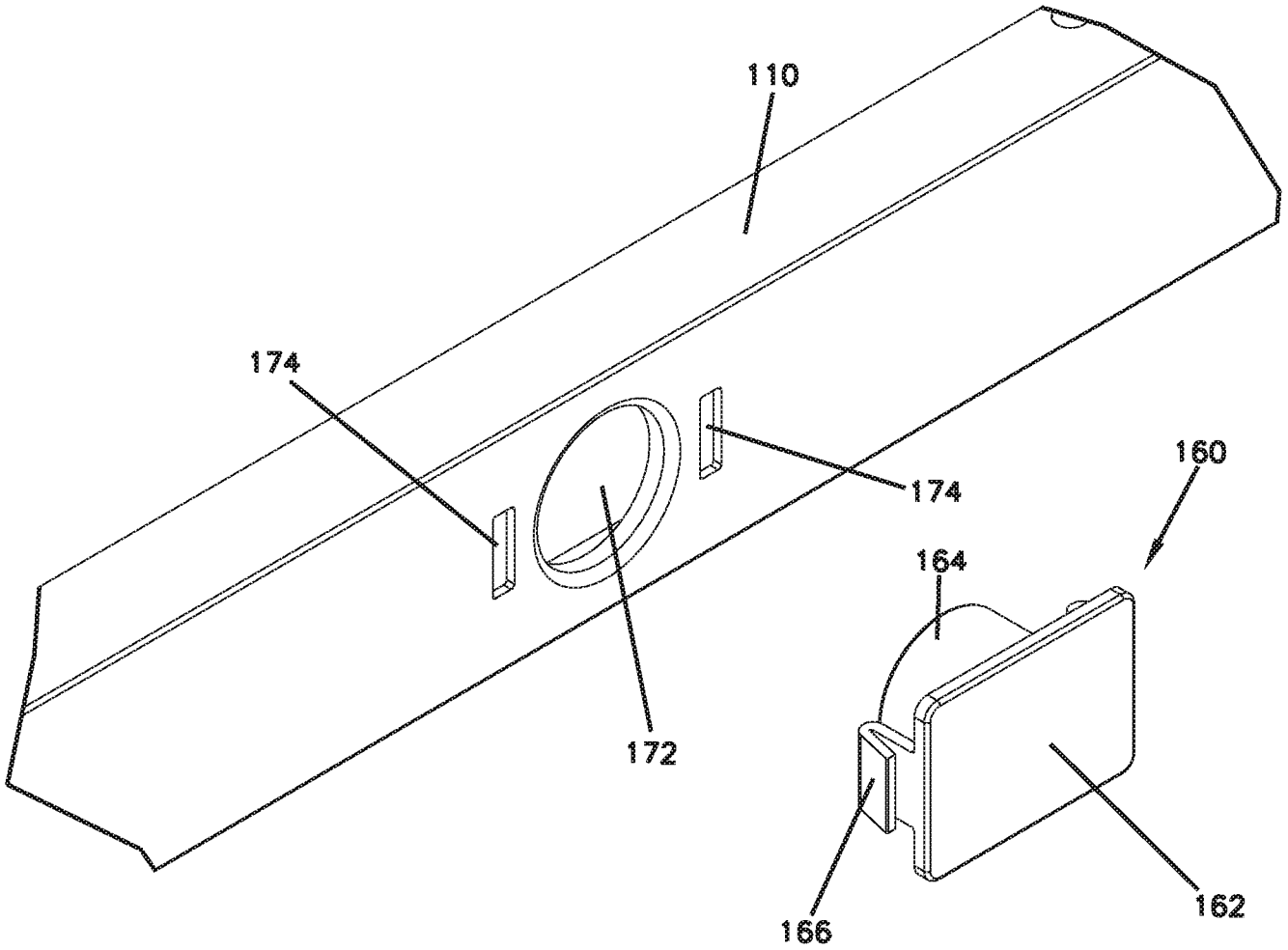
FIG. 11 is an exploded perspective view of the frame and clip shown in FIG. 10.
Figure 13:
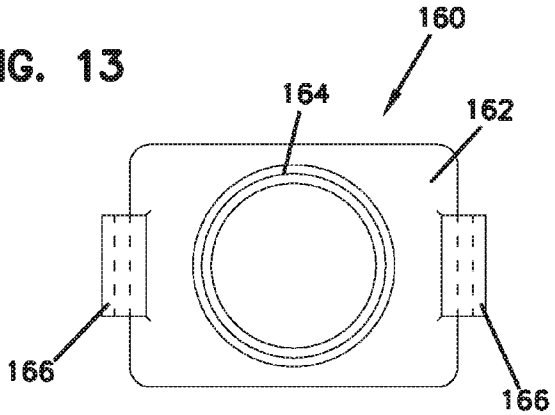
FIG. 13 is a top plan view of the clip shown in FIG. 12.
Figure 15:
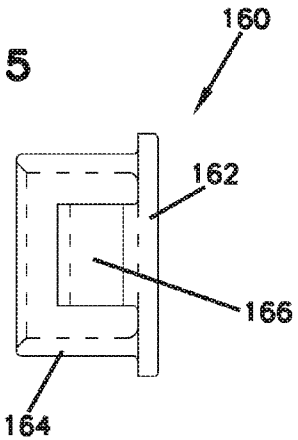
FIG. 15 is a side elevational view of the clip shown in FIG. 12.
Figure 12:
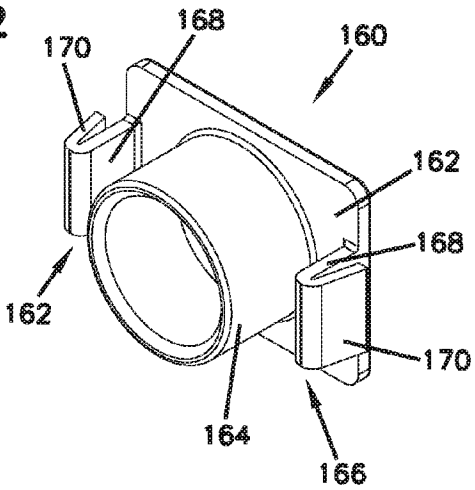
FIG. 12 is a perspective view of the clip shown in FIG. 10.
Figure 14:
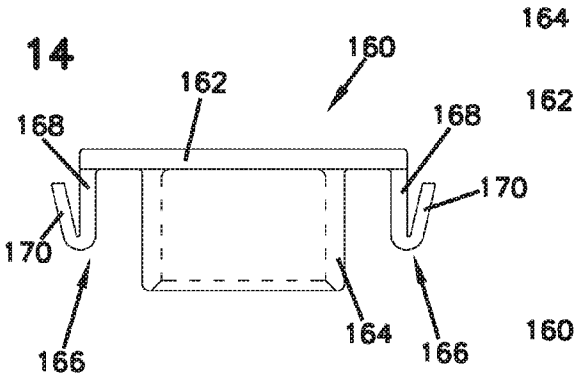
FIG. 14 is a rear elevational view of the clip shown in FIG. 12.

Referring now to FIGS. 10 and 11, the cap element (160) mounts to a section of the table top frame (110). The table top frame (110) includes an orifice (172) formed in the wall of the frame (110). Slots (174) are disposed on either side and evenly spaced apart from the orifice (172) that provide for simple snap in type mounting.

As shown in FIGS. 12-15, the cap element (160) includes a base portion (162). The base portion (162) may be rectangular or other conventional shape. A receiving portion (164) is substantially cylindrical and extends outward from a face of the base portion (162). The receiving portion (164) defines a substantially cylindrical inner cavity that is configured for receiving an end of an associated tubular member (146). Tabs (166) mount on opposite sides of the center receiving portion (164). The tabs (166) include a first planar portion (168) that extends out substantially perpendicular to the face of the base (162). A second planar portion (170) extends from the distal end of the first planar portion (168) and projects downwardly towards the plane of the base portion (162) and slightly laterally outward. An acute angle is therefore formed between the planar portions (168 and 170). The cap element (160) may be a monolithic molded element. Such a construction provides for the tabs (166) to resiliently flex so that the first planar portion (168) and the second planar portion (170) may be crimped together and then the second planar portion (170) flexes backward to its original position. The cap element (160) may be a lightweight plastic with a low friction surface so that the tubular member (146) may rotate freely within the internal cavity of the receiving portion (164).

The present invention also provides for easy construction and assembly. The cap element (160) may simply be snapped into position and retained by the table top frame (110) as shown in FIGS. 10 and 11. To mount the cap element (160) to the frame (110), the element (160) is pushed from the outside with the receiving portion (164) inserting through the center orifice (172) of the table top frame (110). Simultaneously, the tabs (166) extend through the corresponding slots (174). As the cap element (160) is pushed inward with the receiving portion (164) passing through the orifice (172), the planar portions (168, 170) are forced together by the sides of the slots (174). However, when the tabs (166) are pushed sufficiently through these slots (174) so that the second planar portions (170) have passed entirely beyond the slots (174), the resilience of the tabs (166) causes the second planar portions (172) to return to their initial state. Therefore, the ends of the second planar portions (170) closest to the plane of the base (162) extend laterally outward beyond the slots (174) and engage an inner wall of the table top frame (110). Therefore, once mounted, the cap element (160) may not be extracted back through the orifice (174) and is held securely in place. It can be appreciated that the mounting operation of the cap elements (160) simply occurs by pushing the element into place with secure engagement that requires no tools or special skills.

The use of the cap elements (160) provides a low friction surface and simple and easy mounting for the tubular members (146) and allows easy rotation of the folding framework (102). Moreover, with the use of mechanical struts (200), the need for torsion bars along the rotational axes at the upper ends of the legs (124) of the folding framework is eliminated. The mechanical struts have a force ratio of about 4 that provides for optimizing folding assist aided by the low friction and lightweight construction of the cap elements (160) and tubular members (146). Not only is weight reduced, but function is also simplified. Moreover, the struts (200) being tuned to the various phases of folding and unfolding provides for easier and safer transition between the folded and unfolded positions. The use of mechanical struts also overcomes the problems related to leakage and degradation of pneumatic springs over time so that the function of the table (100) and the folding assist may be maintained throughout the useful life of the table and seating arrangement (100).

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A folding table comprising:

a pair of table tops, each of the table tops having a table top frame;

a folding framework supporting the table tops and folding the table tops between a first position and a second position, the folding framework including a rotatably mounted tubular cross member defining a rotational axis with each of the table tops;

a folding assist system to offset forces during folding, the folding assist system comprising;

a mechanical strut assembly attached to the folding framework and providing a biasing force;

a cap having a receiving portion inserting into an orifice in the table top frame and aligned with the rotational axis; an end of the tubular cross member inserting into the receiving portion of the cap.

2. A folding table according to claim 1, wherein folding assist system comprises a pair of the caps including a first cap and a second cap, a first end of the tubular member inserting into the first cap and a second end of the tubular member inserting into the second cap to provide relative rotation between the tubular member and the caps.

3. A folding table according to claim 1, wherein the cap comprises retaining tabs and wherein the table frame comprises slots, wherein the retaining tabs insert into the slots to retain the cap with a receiving portion in a hole in the table top frame.

4. A folding table according to claim 1, further comprising seating mounted to the folding framework.

5. A folding table according to claim 1, wherein the mechanical strut assembly comprises a first spring and a second spring, wherein the first spring has a different spring constant than the second spring.

6. A folding table according to claim 1, wherein the mechanical strut assembly comprises a telescoping portion and wherein a first end of the mechanical strut assembly mounts to the folding framework and a second end of the mechanical strut assembly mounts to the table top frame.

7. A folding table and seating assembly comprising:

a pair of table tops, each of the table tops having a table top frame;

seating associated with at least one of the table tops;

a folding framework comprising:

a leg assembly for each of the table tops including a pair of legs and supporting the table tops; the folding framework folding the table tops between a first use position and a second folded position;

a rotatably mounted tubular first cross member for each of the table tops rotatably mounted to the table top frame and defining a rotational axis with each of the table tops, wherein an upper end of each of the legs mounts to the first cross member;

a second cross member fixedly mounted to the table top frame;

a third cross member fixedly connecting the legs of each pair of legs; the third cross member being below the second cross member in the first use position;

a mechanical strut assembly having a telescoping outer housing, at least one spring within the outer housing; the mechanical strut mounting at a first end to the second cross member and at a second end to the third cross member;

wherein the mechanical strut assembly is adapted to offset at least a portion of forces acting to accelerate and to impede folding and unfolding at different phases of folding and unfolding operations of the folding table and seating assembly.

8. A folding table and seating assembly according to claim 7, wherein the mechanical strut assembly comprises a plurality of springs.

9. A folding table and seating assembly according to claim 7, wherein the mechanical strut assembly comprises a first spring and a second spring, wherein the first spring has a different spring constant than the second spring.

10. A method of folding a folding table and seating apparatus between a first position and a second position, the folding table and seating apparatus comprising a folding framework and a plurality of leg assemblies rotatably mounted to the framework, each leg assembly rotating about tubular member extending along an associated axis of rotation; the method comprising:

providing at least one mechanical strut having springs adapted to offset forces resisting or accelerating folding, each of the at least one mechanical struts mounting to the framework connecting one of the leg assemblies to the framework;

providing a cap snapping into an orifice in the framework aligned with the tubular member and having a substantially cylindrical receiving section receiving an end of the tubular member; and moving the folding table and seating apparatus from the first position to the second position with folding assistance being provided solely by the at least one mechanical strut.

11. A method according to claim 10, wherein cap element comprises a receiving portion defining an inner cylindrical cavity, and wherein the tubular member rotates within the inner cylindrical cavity.

12. A cap member comprising:

a planar base portion;

a pair of tab portions extending from a face of the base portion at opposed ends of the base portion;

a cylindrical receiving portion extending from the face of the base portion intermediate the tab portion, the cylindrical receiving portion defining an inner cylindrical cavity.

13. A cap member according to claim 12, wherein the cap member comprises a monolithic element.

14. A cap member according to claim 12, wherein each of the tab portions comprises:

a first planar portion having a first end mounted to the face of the base portion and a second extended end, the first planar portion extending substantially perpendicular to the face of the base portion;

a second planar portion attached to the second extended end of the first planar portion, the second planar portion extending substantially towards the base portion.

15. A cap member according to claim 14, wherein the first planar portion and the second planar portion define an acute angle therebetween.

16. A cap member according to claim 14, wherein the second planar portion is flexibly mounted to the first planar portion.

17. A folding table and seating assembly according to claim 7, comprising two pairs of legs for each table top, each of the pairs of legs having the third cross member; and a linkage connecting the third cross members of each table top to actuate folding and unfolding the pairs of legs.

* * * * *